US007111446B2

(12) United States Patent
Wassenhoven et al.

(10) Patent No.: US 7,111,446 B2
(45) Date of Patent: Sep. 26, 2006

(54) METHOD AND APPARATUS FOR OPERATING AN OPEN-END ROTOR SPINNING UNIT

(75) Inventors: Heinz-Georg Wassenhoven, Mönchengladbach (DE); Norbert Coenen, Mönchengladbach (DE)

(73) Assignee: Saurer GmbH & Co. KG, Monchengladbach (DE)

( * ) Notice: Subject to any disclaimer, the term of this patent is extended or adjusted under 35 U.S.C. 154(b) by 0 days.

(21) Appl. No.: 11/133,081

(22) Filed: May 19, 2005

(65) Prior Publication Data

US 2005/0279076 A1 Dec. 22, 2005

(30) Foreign Application Priority Data

Jun. 16, 2004 (DE) ..... 10 2004 029 020

(51) Int. Cl.
*D01H 4/08* (2006.01)

(52) U.S. Cl. ..... 57/404; 57/407

(58) Field of Classification Search ..... 57/404, 57/406, 407

See application file for complete search history.

(56) References Cited

U.S. PATENT DOCUMENTS 4,094,133 A * 6/1978 Furrer ..... 57/264
5,906,092 A * 5/1999 Hattori ..... 57/100
6,590,307 B1 * 7/2003 Coenen ..... 310/90.5
2002/0002816 A1 1/2002 Coenen
2004/0000133 A1 * 1/2004 Wassenhoven et al. ..... 57/406
2004/0154280 A1 8/2004 Wassenhoven

FOREIGN PATENT DOCUMENTS

DE 100 22 736 A1 11/2001
DE 103 05 279 A1 8/2004

* cited by examiner

*Primary Examiner*—Shaun R. Hurley
(74) *Attorney, Agent, or Firm*—Alston & Bird LLP

(57) ABSTRACT

An open-end spinning unit, which comprises a spinning rotor 1 that rotates during the spinning operation at a high rotational speed in a closed rotor housing 2. The spinning rotor is rotated by an individual electric motor drive 18 and supported in a smoothly running bearing assembly. When the drive is disconnected and the rotor housing is properly closed by a cover element 8, the spinning rotor is biased and rotated by an airflow resulting from a vacuum prevailing in the rotor housing and the motor drive operates as a generator. At least one of the electric quantities $P_v$, $G_v$ which develop during the generator operation of the drive 18 is monitored, and upon exceeding a threshold value which can only be attained when the cover element is properly closed, a signal S is generated and processed in a control unit 30 to cause the cover element 8 on the rotor housing 2 to be locked, and thereafter the drive 18 is connected to its electrical supply to rotate the rotor at high speed.

12 Claims, 2 Drawing Sheets

METHOD AND APPARATUS FOR OPERATING AN OPEN-END ROTOR SPINNING UNIT

BACKGROUND OF THE INVENTION

The invention relates to a method for operating an open-end rotor yarn spinning unit, and an apparatus for carrying out the method.

Different types of open-end rotor spinning units are known, which comprise a spinning rotor that rotates during the spinning process at a high rotational speed in a rotor housing which is closed by a cover element and kept under a vacuum. The open-end rotor spinning units differ both with respect to the bearing mount of their spinning rotors and with respect to their drive.

The majority of the open-end spinning rotor units that are currently on the market and disclosed, for example, in DE 103 05 279 A1, and corresponding U.S. Publ. No. 2004/154280 comprise spinning rotors that are supported with their rotor shaft in the cusp of a so-called twin disk bearing. In the case of such twin disk bearings, it is common to provide for axially securing the spinning rotor, an additional thrust bearing, which may be constructed either as a mechanical bearing or as a magnetic bearing. The drive of such bearing mounted spinning rotors normally occurs via a tangential belt which runs the length of the machine, with a contact roll causing the tangential belt to lie against each rotor shaft of the spinning rotor. The above described bearing and drive assemblies permit spinning rotor speeds greater than 100,000 rpm.

Besides these spinning rotors that are mechanically supported in twin disk bearing assemblies, it is also known to support spinning rotors in bearing assemblies in a noncontacting manner, and to operate them by individual electric motors, for example, by electromagnetic drives. Noncontacting, smoothly operating bearing assemblies are, for example, air bearings or magnetic bearings.

DE 100 22 736 A1 and corresponding U.S. Publ. No. 2002/002816 describe an open-end spinning unit with such a magnetic bearing assembly. In this assembly, the rotor shaft of the spinning rotor is supported in a noncontacting manner via two bearing points that are arranged in axially spaced relationship and formed by paired permanent magnets. These paired permanent magnets are constructed and arranged such that respectively opposite magnet poles face each other, so that respectively repulsive magnetic bearing forces are operative between the permanent magnet on the rotor side and the permanent magnet on the stator side.

The permanent magnets on the stator side are also surrounded by electric windings that can be switched in a defined manner, and which permit increasing or decreasing the magnetic forces as a function of the direction of the electric current flow. In this process, the electric windings are activated via a corresponding control device as a function of signals of a sensor, which measures the axial deviation of the rotor from its desired position.

The drive of such spinning rotors that are supported in a noncontacting manner, normally occurs by means of individual electric motor drives, preferably DC motors, which are each arranged between the magnetic bearing points.

Irrespective of the type of bearing mount and/or the type of the drive of spinning rotors, it is necessary to open such open-end spinning devices from time to time, for example, for cleaning the spinning rotor. This means that the particular spinning rotors must first be slowed down to a standstill. After opening the rotor housing, they can then be cleaned, for example, by a mechanical scraper of an automatically operating piecer carriage or by the operating personnel.

Because of the high rotational speeds, at which the spinning rotors rotate during the spinning process, one must make sure that the piecer carriage or the operating personnel can open the rotor housing only when the spinning rotor has slowed down to no more than a considerably reduced speed. Furthermore, when restarting the spinning rotor, it must be made sure that the rotor housing is properly closed by a cover element.

For this reason, open-end rotor spinning units with a spinning rotor that is mechanically supported in a twin disk bearing assembly and adapted for being driven by a tangential belt, comprise a rotor brake, whose brake shoes engage the rotor shaft in the fashion of tongs and, in so doing, decelerate it. This means that the rotor brake starts acting, as soon as the cover element that closes the rotor housing is actuated in the direction of "opening".

At the same time as the rotor brake is actuated, a contact roll which brings during the spinning operation the tangential belt of machine length into frictional contact with the rotor shaft of the particular spinning rotor, is raised and thus separates the driving engagement of the rotor shaft and the tangential belt.

The above described rotor brake remains in contact with the rotor shaft, until the cover element engages again in the prescribed manner, i.e., the rotor housing is properly closed.

In practical operation, the above described devices have proved themselves in connection with spinning rotors that are supported in twin disk bearing assemblies. In the case of spinning rotors that are driven by individual motors, in particular when these spinning rotors are supported in a magnetic bearing assembly, such devices are however less advantageous or unusable for various reasons.

Spinning rotors that are driven by individual motors are normally not decelerated to a standstill, for example, by a mechanical rotor brake, but electrically. This means that in the case of such drives the flow direction of the motor current is simply reversed for stopping the spinning rotors. Such a braking current permits decelerating spinning rotors that are driven by individual motors, to a standstill within the shortest time and in a material protective manner. However, these individually driven and magnetically supported spinning rotors require taking additional measures which ensure that before opening the rotor housing, the spinning rotor rotates only below a predetermined rotational speed limit, and in particular that the rotor housing is also properly closed before a restart of the spinning rotor.

The known open-end spinning units with spinning rotors that are driven by individual motors and supported in magnetic bearings, are therefore equipped with special sensor devices, which monitor the proper closing of the rotor housing.

Based on the above-described state of the art, it is an object of the invention to develop a method and an apparatus, which enable a cost favorable and reliable operation of open-end rotor spinning units, whose spinning rotors are driven by individual motors and supported in magnetic bearing assemblies.

SUMMARY OF THE INVENTION

The above and other objects and advantages of the invention are achieved by the provision of an open-end spinning apparatus wherein during rotor start-up, a vacuum is drawn in the rotor housing which causes the rotor to rotate and the electric motor drive to rotate and operate in the generator mode. At least one of the electric quantities that develop during the generator operation of the drive is monitored, and upon the electric quantity exceeding a predetermined threshold value, a signal is sent to an actuator which locks the cover element in the properly closed position.

The method of the invention has in particular the advantage that it permits drawing conclusions as to the state of closing of the rotor housing directly from the state of motion without additional sensor equipment. This means that only when the rotor housing is properly closed does an airflow build up in the vacuum biased rotor housing, which accelerates the spinning rotor despite the disconnected drive, to a rotational speed at which at least one electric quantity of the spinning rotor drive running in generator operation exceeds the predetermined threshold value. Only upon exceeding this threshold value is a signal generated, which is processed in a control unit to lock the cover element and then connect the motor drive to its energy supply. Stated in other words, the predetermined threshold value is selected so as to be attainable only when the cover element is properly in the closed position.

Both the generation of a measurable electric quantity by the spinning rotor drive while running in generator mode, and the monitoring thereof, as well as the generation of a signal, when a threshold value of one of the electric quantities is exceeded, and the processing of the signals occur by devices which are in any event needed for operating an open-end spinning unit. This means that when carrying out the method of the invention, no additional devices will be needed, and with that likewise no additional costs will be incurred.

An advantageous form of realizing the method is provided in that a brushless DC motor without sensors is used as the drive for the spinning rotor. The rotational speed, to which the airflow pneumatically accelerates the drive with the spinning rotor, is determined in this process, for example, by means of the rotation of the rotating field of the motor. This means that the speed of the spinning rotor is determined in a simple manner by tapping and evaluating as an easily measurable electric quantity the phase voltage which develops during the rotation of the motor in the motor coil of the motor. In this process, the phase voltage is tapped via a sensor device that is already provided on the drive of the spinning rotor, i.e., via a device that is in any event needed for the operation of the DC motor.

An alternative possibility of detecting an electric quantity of the spinning rotor drive while running in generator operation, which quantity is proportional to the rotational speed of the spinning rotor, consists, in that the generator voltage of the DC motor is measured and monitored with respect to a limit value.

Regardless of the kind of electric quantity which is used to determine the rotation of the spinning rotor, it has shown that the electric quantity reaches a threshold value that can be used for a reliable determination of the state of closing of the rotor housing, when the spinning rotor rotates by the action of the airflow at about 2,000 rpm. This means that the reaching of such a spinning rotor speed is a reliable indicator of the fact that the rotor housing is properly closed by the cover element.

Since an improperly closed rotor housing may perhaps unintentionally burst open during the spinning operation, which can lead because of the high rotor speeds to considerable material damage and bodily injury, and which must therefore be avoided under all circumstances, an advantageous embodiment of the method may be employed wherein upon reaching a rotational speed which is clearly below that at which the threshold value is reached, the spinning rotor is decelerated for a limited time to a lower rotational speed at least once by short circuiting the motor connections of the drive. Thereafter, the rotor is accelerated to a rotational speed at which the threshold value is reached.

By electrically decelerating the spinning rotor and subsequently accelerating it again pneumatically to a rotational speed at which a threshold value is reached, it is made sure that the rotation of the spinning rotor is due to the airflow in the rotor housing, which develops only when the cover element closes the rotor housing in the prescribed manner.

A signal that is generated upon reaching a threshold value of the electric quantity of the spinning rotor drive while running in generator mode, is processed in the control unit to the extent that an actuator of the locking device is initiated, which electromagnetically keeps the cover element in position on the rotor housing.

BRIEF DESCRIPTION OF THE DRAWINGS

In the following, the invention is described in greater detail with reference to an embodiment illustrated in the drawings, in which.

DETAILED DESCRIPTION OF THE PREFERRED EMBODIMENT

Figure 1:
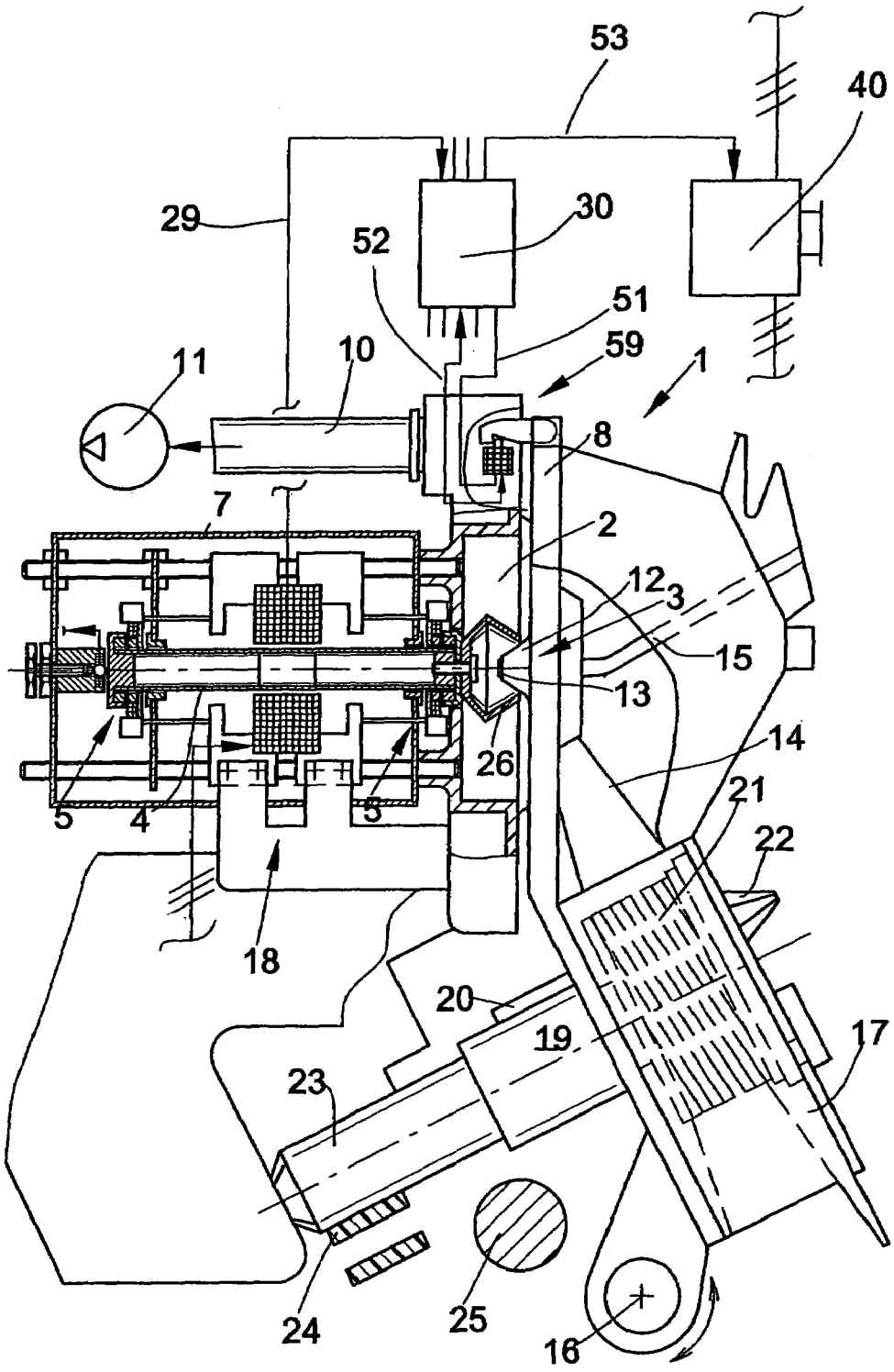
FIG. 1 is a side view of an open end rotor spinning unit with a spinning rotor driven by an individual motor and supported in a magnetic bearing, whose rotor cup rotates in a vacuum biased rotor housing that can be closed by a cover element.

An open-end rotor spinning unit as shown in FIG. 1 is generally indicated by the numeral 1, and it comprises as usual a rotor housing 2, in which a spin cup 26 of a spinning rotor 3 rotates at a high speed. The spinning rotor 2 is driven by an individual electric motor drive, preferably a DC motor 18, and supported with its rotor shaft 4 in a magnetic bearing assembly 5.

In a known manner, the forwardly open rotor housing 2 is closed during the spinning process by a pivotally supported cover element 8, and it is connected via a corresponding suction line 10 to a source of vacuum 11 that generates a spinning vacuum as is needed in the rotor housing 2 for producing a yarn. As indicated, a recess of the cover element 8 accommodates a channel plate adapter 12, which comprises a yarn withdrawal nozzle 13 as well as the outlet region of a fiber feed channel 14. The yarn withdrawal nozzle 13 connects to a yarn withdrawal tube 15.

The cover element 8, which mounts in the illustrated embodiment an opening roll housing 17 with bearing brackets 19, 20 on its rear side for respectively supporting an opening roll 21 and a fiber sliver intake cylinder 22, is supported for limited rotation about a pivot pin 16. A rotating tangential belt 24 having a length of the machine drives the opening roll 21 in the region of its whorl 23, whereas the drive (not shown) of the fiber sliver intake cylinder 22 is performed preferably via a worm gear assembly, which connects to a drive shaft 25 that extends over the length of the machine.

In the place of the tangential belt 24 as well as the drive shaft 25, it is also possible to provide individual drives for the opening roll 21 and the fiber sliver intake cylinder 22, respectively. For example, the drive of the opening roll 21 may be constructed as an external rotor motor as disclosed in DE 103 38 901 A1. In such a case, the drive of the fiber sliver intake cylinder 22 may occur preferably via a stepping motor, which is flanged from the back to the cover element 8.

Figure 2:
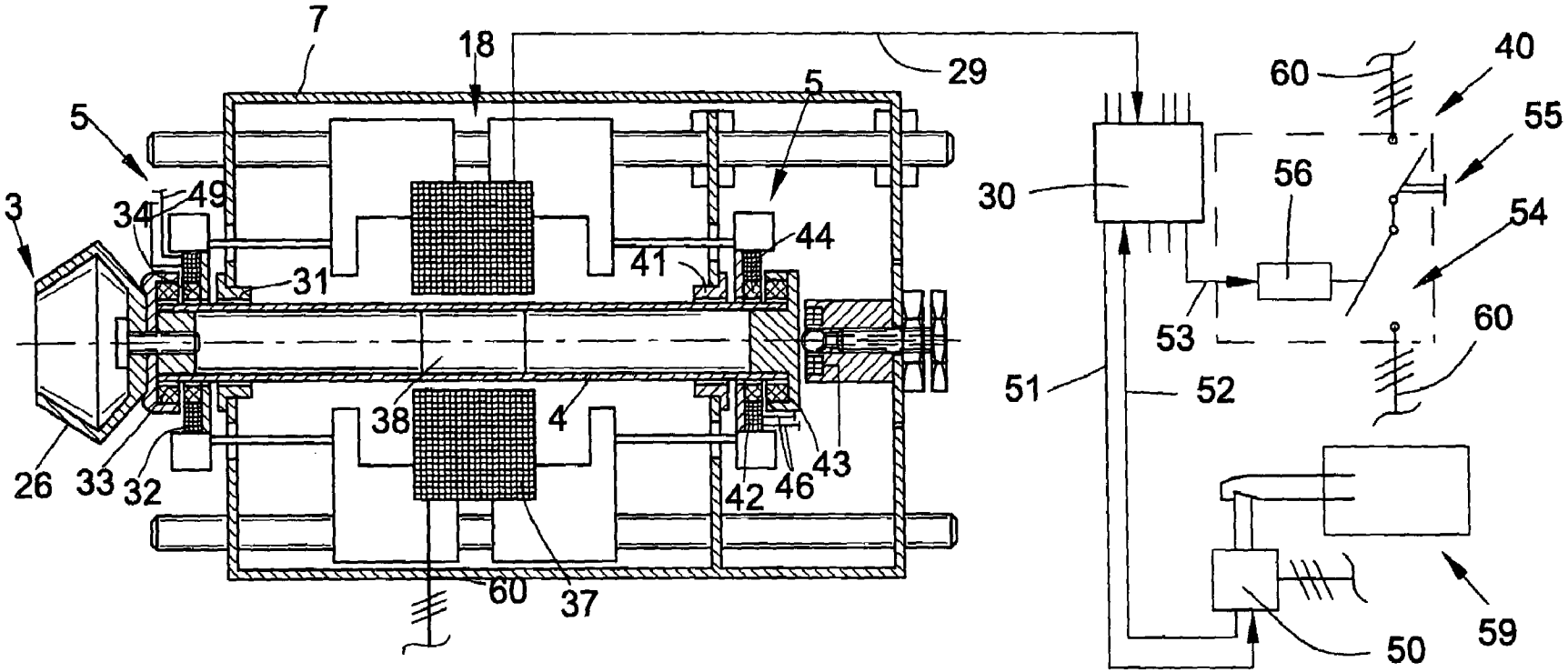
FIG. 2 is an enlarged view of the spinning rotor of FIG. 1, which is driven by an individual motor and supported in a magnetic bearing, as well as a circuit arrangement for carrying out the method of the invention.

As further indicated in FIG. 1 and in particular in FIG. 2, a motor coil 37 of the DC motor 18 connects via a signaling line 29 to a control unit 30. The control unit 30 furthermore connects via control lines 51 and a signaling line 52 respectively to an actuator 50 of a locking device 59, and via a control line 53 to a switching element 40 for starting up the spinning rotor 3.

FIG. 2 is an enlarged view of the magnetic bearing assembly 5 with magnetic bearing components 32, 33, 34 and 42, 43, 44, respectively, as well as of the drive 18 of the spinning rotor 3 with its motor magnets 38 and its motor coil 37. The drive of the spinning rotor 3 is preferably a cost-favorable, brushless and sensorless DC motor 18. As illustrated, the motor bearing of this DC motor 18 comprises a stator casing 7 that mounts boundary bearings 31 and 41, which represent radial end stops for the rotor shaft 4. These boundary bearings 31, 41, for example, prevent the spinning rotor 3 or rotor shaft 4 from running against the relatively sensitive magnetic bearing components 34, 44, when vibrations occur.

As illustrated, the stator housing 7 mounts the non-rotating components of the magnetic bearing assembly 5. In greater detail, these include the magnetic bearing coils 32 and 42, which can be energized in a defined manner via connection lines 49 and 46, as well as the bearing magnets 34 and 44.

Arranged opposite to and at a small distance from these bearings magnets 34 and 44, which are preferably permanent magnets, are rotatably supported bearing magnets 33, 43. Likewise, the bearing magnets 33, 43 are preferably constructed as permanent magnets.

During the spinning operation, the spinning rotor 3 or the rotor shaft 4 are stabilized in the magnetic bearing assembly 5 by means of a so-called center position control device. Such center position control devices are known and described in greater detail, for example, in DE 100 22 736 A1.

As further indicated in FIG. 2, the motor coil 37 of the DC motor 18 connects via a signaling line 29 to a control unit 30, for example, an operating position computer. The control unit 30 furthermore connects via control or signaling lines 51, 52 to an actuator 50, for example, an electromagnetically actuatable locking pin of a locking device 59. Furthermore, the control unit 30 connects via a control line 53 to a switching element 40. The switching element 40 comprises, for example, two contacts that are interposed into an energy supply line 60, namely a contact 54 that can be electrically activated via a switching magnet 56, as well as a manually actuatable contact 55.

OPERATION OF THE APPARATUS

For example, after cleaning a spinning rotor 3, it will first be necessary for starting up the open-end spinning unit 1 to close the rotor housing 2 by the cover element 8, and to activate with that an airflow in the rotor housing 2. This means that when the rotor housing 2 is properly closed, the spinning vacuum prevailing in the rotor housing 2 causes an airflow to become effective in the rotor housing 2. By the action of this airflow, the spinning rotor 3 starts to rotate, and with that also the drive 18. In this process, the rotation of drive 18 is monitored, which runs in generator mode. This means that at least one of the electric quantities that develop during the generator operation of drive 18 is detected. It is preferred to determine, for example, via the phase voltage in motor coil 37, the rotation of the rotating field of the brushless and sensorless DC motor 18, and with that the rotational speed of spinning rotor 3, and when the monitored electric quantity reaches a threshold value, to generate a signal that is processed in control unit 30.

To ensure that the determined rotation of the spinning rotor 3 is due to the airflow in the rotor housing 2, which, as aforesaid, is operative only with a properly closed rotor housing 2, the spinning rotor 3 will first be decelerated, once it has reached a rotational speed of, for example, 2000 rpm, at least one more time by short circuiting the motor connections, for a limited time, to a clearly lower rotational speed of, for example, 1000 rpm.

After releasing the short circuit brake, the spinning rotor 3 is again accelerated by the airflow to a rotational speed of at least 2000 rpm, at which the monitored electric quantity of the drive 18 reaches a predetermined threshold value.

Upon reaching again the predetermined minimum speed of, for example, 2000 rpm, possibly in connection with the measured acceleration values of the spinning rotor 3, a signal is generated, which is interpreted in the control unit 30 to the extent that the rotor housing 2 is properly closed.

Subsequently, the control unit 30 signals via control line 51 for the actuation of the locking device 59. When the control unit 30 receives via signaling line 52 the message that the actuator 50 of the locking device 59, for example, an electromagnetically activatable locking pin, is properly engaged, the control unit 30 will signal for the switching element 40 to be released. This means that an electromagnetically activatable contact 56 arranged in energy supply line 60 is actuated. Subsequently, for example, by manually actuating a further contact 55 of the switching element 40, it will be possible to connect the drive 18 of the spinning rotor 3 to the energy supply and to start the spinning rotor in a defined manner.

When the open end spinning unit 1 is shut down, because it becomes necessary to clean, for example, the spinning rotor 3, it will be possible to open the rotor housing 2, only when the rotor speed has dropped below a certain level.

This means that also when the open-end spinning unit 1 is shut down, at least one electric quantity will be monitored during the generator operation of drive 18, and be processed in the control unit to the extent that the actuator 50 of the locking device 59 releases the cover element 8 only when the decelerating spinning rotor 3 falls below a predetermined rotational speed level.

Many modifications and other embodiments of the invention set forth herein will come to mind to one skilled in the art to which the invention pertains, having the benefit of the teachings presented in the foregoing description and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

The invention claimed is:

1. A method for operating an open-end rotor spinning unit, which comprises a spinning rotor that rotates during the spinning operation at a high speed in a closed rotor housing which is closed by a cover element which is moveable between open and closed positions, with the spinning rotor being operated by an individual electric motor drive and supported with its rotor shaft in a smoothly running bearing assembly, said method comprising the step of biasing and rotating the spinning rotor by an airflow resulting from a vacuum which is generated in the rotor housing and while the drive is disconnected from its energy supply and is operated as a generator, monitoring at least one of the electric quantities that develop during the generator operation of the drive, generating a signal upon the monitored electric quantity exceeding a predetermined threshold value which can only be attained when the cover element is properly closed, processing the signal in a control unit so as to cause the cover element on the rotor housing to be locked in the closed position, and then connecting the drive to its energy supply to rotate the spinning rotor.

2. The method of claim 1, wherein the drive comprises a DC motor, and wherein the phase voltage ($P_v$) is used to monitor the rotating field of the motor.

3. The method of claim 1, wherein the drive comprises a DC motor, and wherein the generator voltage ($G_v$) of the motor is monitored.

4. The method of claim 1, wherein as the threshold value for the monitored electric quantity ($P_v$, $G_v$), a rotational speed of the spinning rotor is used, which is about 2000 rpm.

5. The method of claim 1, wherein upon reaching a rotational speed limit, which is clearly below the rotational speed at which the threshold value is reached, the spinning rotor is decelerated for a limited time to a lower rotational speed at least once by short-circuiting the motor connections of the drive, and that it is only then accelerated to a rotational speed at which the threshold value is reached.

6. The method of claim 1, wherein the step of processing the signal includes actuating an actuator which electrically locks the cover element on the rotor housing such that an opening of the rotor housing will no longer be possible, when the rotational speed of the spinning rotor exceeds a rotational speed limit.

7. The method of claim 6, wherein the step of connecting the drive to its energy supply includes releasing a switching element for restarting the drive of the spinning rotor only when the cover element has previously been locked in a proper manner.

8. An open end rotor spinning apparatus comprising a spinning motor mounted in a housing for rotation at high speed during the spinning operation, a cover element pivotally mounted for movement between a closed position closing the housing and an open position, an individual electric motor drive for rotating the spinning rotor and which is capable of operating in generator mode when it is disconnected from its energy supply and is externally driven, a vacuum system for drawing a partial vacuum in the housing while causing the spinning rotor to rotate from the resulting airflow through the housing and thereby cause the electric motor drive to operate in generator mode, a control unit for monitoring an electric quantity of the electric motor drive while running in generator mode and for generating a signal when a predetermined threshold value of the electric quantity is reached, and an actuator responsive to receiving the signal from the control unit for locking the cover element in said closed position.

9. The apparatus of claim 8 further comprising a switching element for selectively connecting the electric motor drive to an energy supply, and wherein the control unit is configured to actuate the switching element to cause the electric motor drive to rotate the spinning rotor upon receipt of a signal from the actuator that the cover element has been locked in the closed position.

10. The apparatus of claim 9 wherein the electric motor drive is a DC motor.

11. The apparatus of claim 8 wherein the predetermined threshold value is selected so as to be attainable only when the cover element is properly in said closed position.

12. The method of claim 1, comprising the further subsequent steps of disconnecting the drive from its energy supply to cause the drive to operate as a generator while the rotor continues to rotate, monitoring at least one of the electric quantities that develop during the generator operation of the drive to provide an indication of the rotor speed, and processing the at least one of the electric quantities to release the locked rotor housing only when the rotor speed falls below a predetermined value.

* * * * *